US006474008B1

(12) United States Patent
Hofman et al.

(10) Patent No.: US 6,474,008 B1
(45) Date of Patent: Nov. 5, 2002

(54) SOFT LABEL HOLDER

(75) Inventors: James A. Hofman, Stoughton, WI (US); Steven H. Demsien, Oregon, WI (US); Stephen C. Zielke, Stoughton, WI (US)

(73) Assignee: Berol Corporation, Freeport, IL (US)

( * ) Notice: Subject to any disclaimer, the term of this patent is extended or adjusted under 35 U.S.C. 154(b) by 43 days.

(21) Appl. No.: 09/669,126

(22) Filed: Sep. 25, 2000

(51) Int. Cl.[7] ..... B42F 21/00; B42F 21/04
(52) U.S. Cl. ..... 40/359; 40/641
(58) Field of Search ..... 40/359, 641, 760, 40/630, 638

(56) References Cited

U.S. PATENT DOCUMENTS 1,115,216 A * 10/1914 Laviolette
1,481,173 A * 1/1924 Wright
1,732,541 A * 10/1929 Sacerdote
1,742,277 A * 1/1930 Quigley
2,910,985 A * 11/1959 Epstein et al.
4,052,807 A * 10/1977 Schweinsberg
D393,658 S * 4/1998 Barthel
D400,901 S * 11/1998 Chapman et al.

FOREIGN PATENT DOCUMENTS

DE 822841 * 11/1951 ..... 40/641
DE 1562564 * 4/1970 ..... 40/359

* cited by examiner

*Primary Examiner*—Cassandra Davis
(74) *Attorney, Agent, or Firm*—Marshall, Gerstein & Borun

(57) ABSTRACT

A soft label holder for covering the edge of a rigid file having a front surface and a top edge includes a soft member having a front surface, a rear surface, a top edge, a bottom edge, a first end, and a second end. An aperture extends through the front and rear surfaces. The soft member is secured to the front surface of the rigid file with the top edge of the soft member located proximate to the top edge of the file to cover the top edge of the rigid file.

19 Claims, 5 Drawing Sheets

SOFT LABEL HOLDER

FIELD OF THE INVENTION

The present invention relates generally to the field of file label holders, and more specifically, to a soft label holder.

BACKGROUND OF THE INVENTION

Filing labels are used in many different environments, including a variety of organizers, folders, carriers and the like. Many of these environments present potential hazards to a user's hand. These environments may have a sharp plastic, metal, or paper edges which could scrape or injure a user's hand when the user needs to place their hand near or into the environment. The presently known art does not provide for a label holder to protect a user's hand in these environments. Thus it would be advantageous to have a label holder which can be applied to these environments, which could be used to label, sort and identify the contents of a file, and which also would protect a user's hand in that environment.

SUMMARY OF THE INVENTION

One embodiment relates to a soft label holder for covering the edge of a rigid file having a front surface and a top edge. The label holder includes a soft member having a front surface, a rear surface, a top edge, a bottom edge, a first end, and a second end. An aperture extends through the front and rear surfaces. The soft member is secured to the front surface of the rigid file with the top edge of the soft member located proximate to the top edge of the file to cover the top edge of the rigid file.

Another embodiment relates to a file holder having a label holder. The file holder includes an edge, and the label holder includes a substantially flat body provided with a front face and a rear face. The substantially flat body also includes at least one edge of predetermined length configured to substantially cover the edge of the file holder. An aperture extends through the substantially flat body. A depression is formed in the rear face of the substantially flat body and surrounds the aperture. The rear face of the substantially flat body is attached to the edge of the file holder. A label is removably inserted into the depression and visible through the aperture.

In yet another embodiment a soft label holder, for protecting a user's hand while near an edge of a file holder includes a soft member. The soft member includes a front face and a rear face, and at least one edge of predetermined length configured to substantially cover an edge of the file holder. An aperture extends through the soft member. A depression in the rear face of the soft member surrounds the aperture. The soft member is attached to the edge of the file holder along the edge of predetermined length on the rear face of the soft member. A label is removably inserted into the depression and visible through the aperture.

DETAILED DESCRIPTION OF THE PREFERRED EMBODIMENTS

Figure 1:
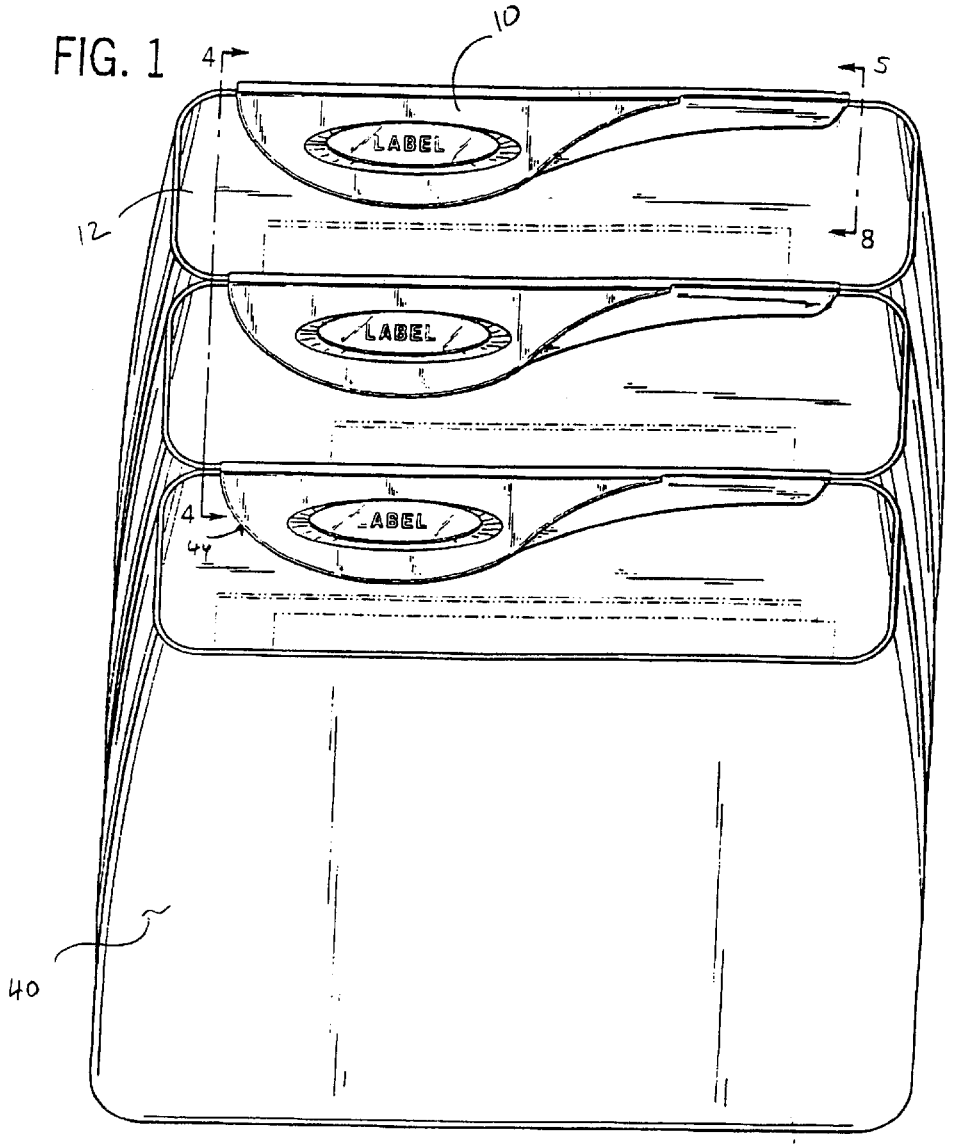
FIG. 1 is a perspective view of the soft label holder applied in a typical working environment.
Figure 3:
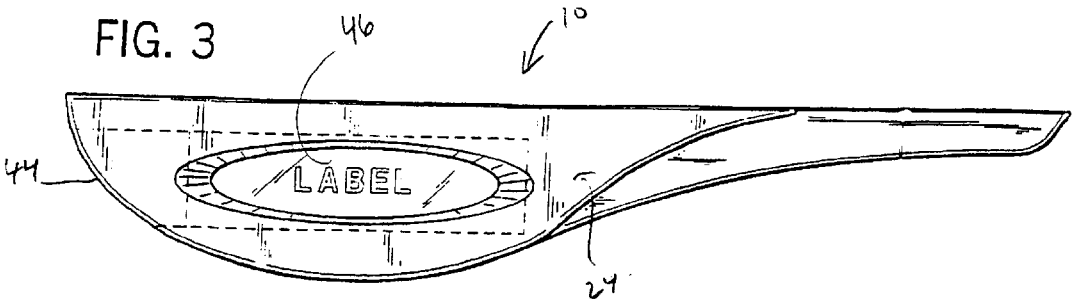
FIG. 3 is a front elevation view of the a soft label holder of FIG. 2.

Referring to FIG. 1 an exemplary embodiment of the soft label holder 10 is attached to a rigid file holder 12. Soft label holder 10 is configured to cover a rigid edge 14 of rigid file holder 12. By covering rigid edge 14, soft label holder 10 protects a user's hand against scrapes with rigid edge 14, and provides for a soft touch to the edge of the file holder.

Figure 2:
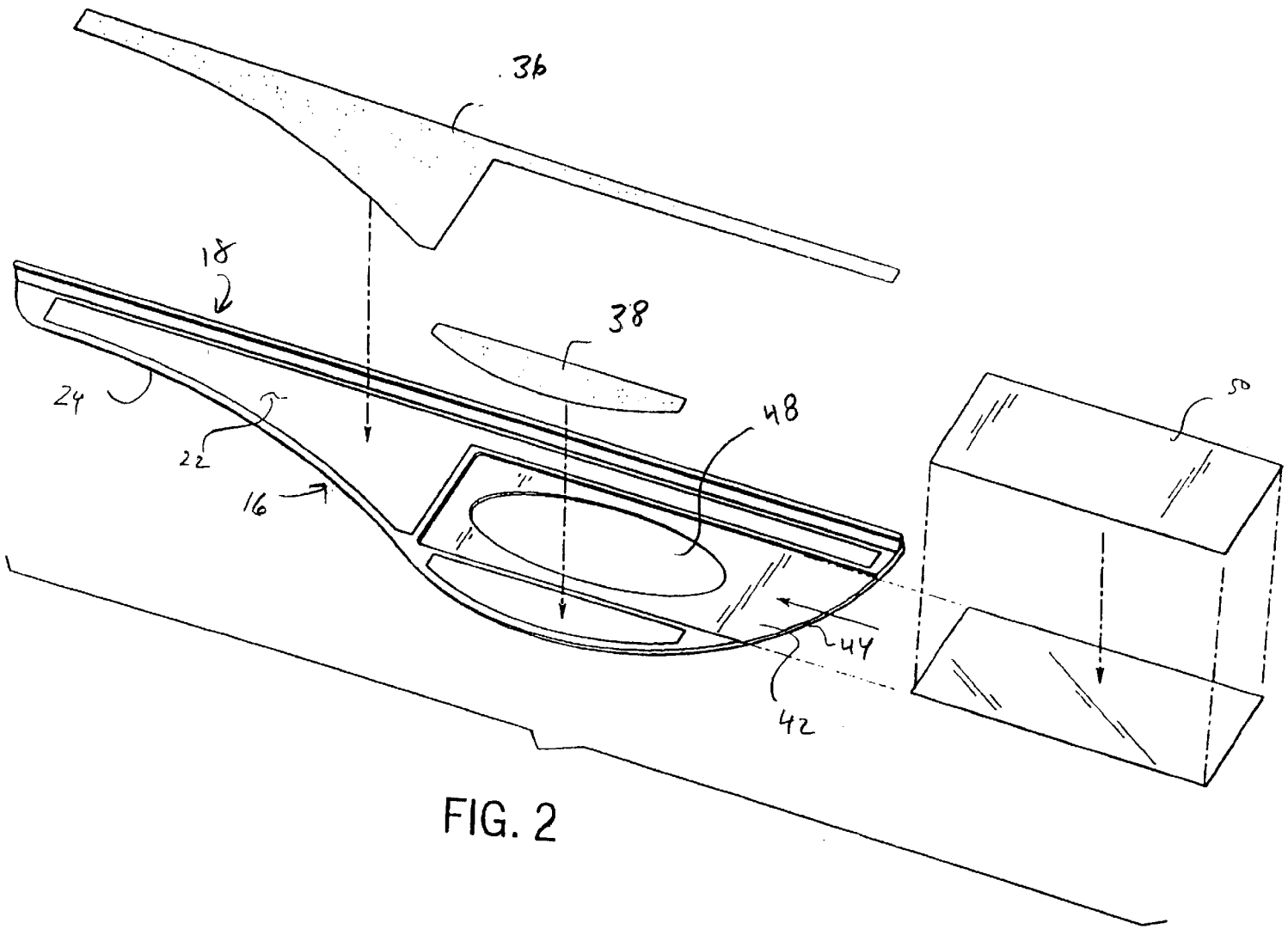
FIG. 2 is an exploded perspective view of a soft label holder according to an exemplary embodiment of the present invention.
Figure 5:
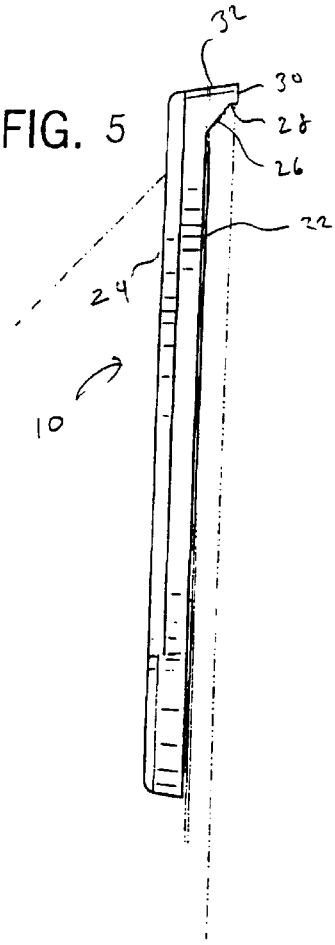
FIG. 5 is a sectional view of the soft label holder taken generally along lines 5—5 of FIG. 1.

Referring to FIG. 2 soft label holder 10 includes a body 16 having a top region 18, and a bottom region 20. Body 16 is substantially flat having a first side 22 that is secured to file holder 12 and an opposing second side 24. In the preferred embodiment body 12 is made of santoprene. However other types of material may be employed as well. For example any soft material capable of protecting against the rigid edge 14 of rigid file holder 12 such as. neoprene, EVA, SBR, Natural Rubber, Flexible PVC, Nitrile, etc.) Santoprene has a durometer hardness range of 90–30. In the preferred embodiment, the durometer hardness of the soft label holder 10 is between 80 and 30. However, durometer hardness above 80 would also provide a "soft" touch.

Figure 4:
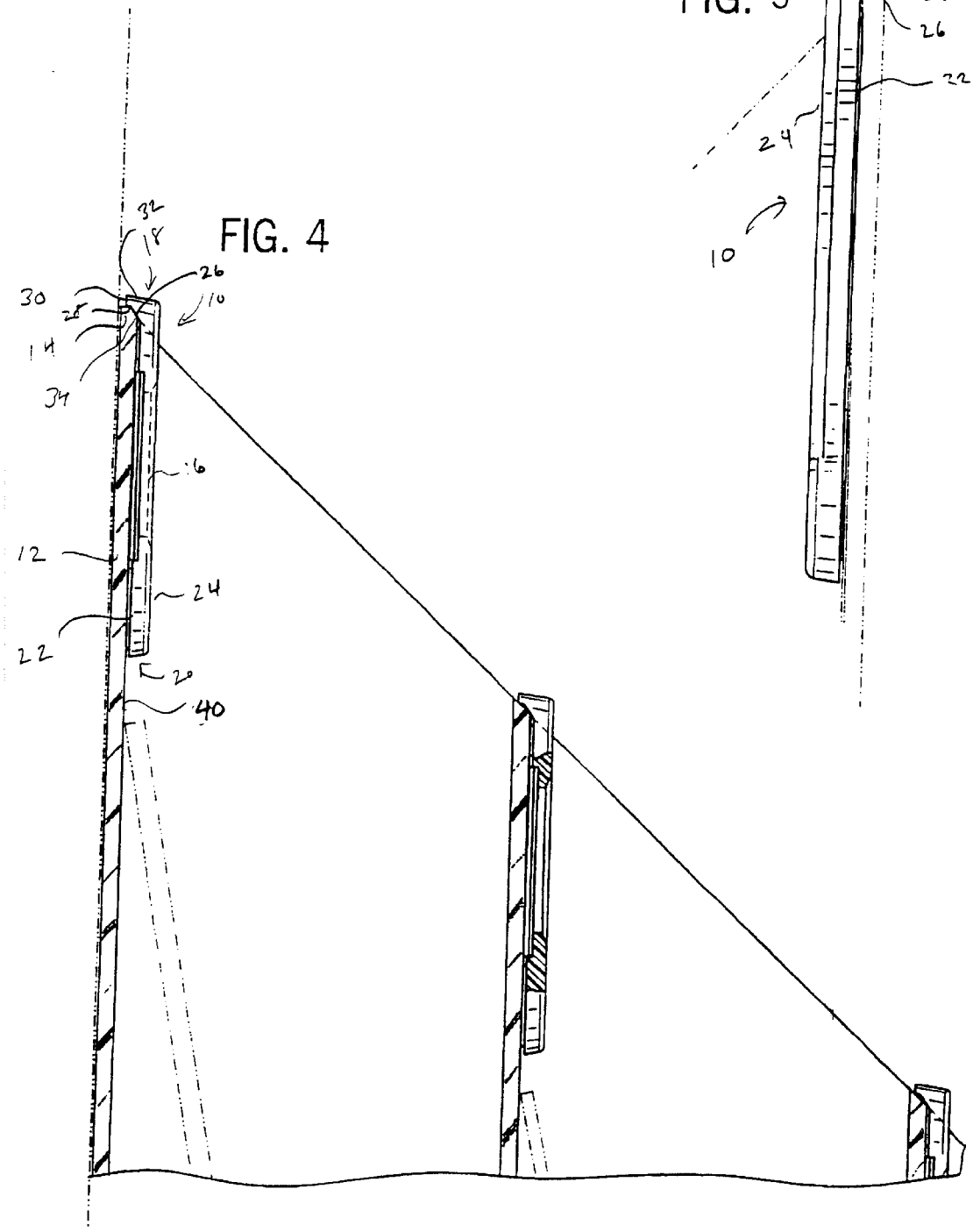
FIG. 4 is a sectional view of the soft label holder taken generally along lines 4—4 of FIG. 1.
Figure 6:
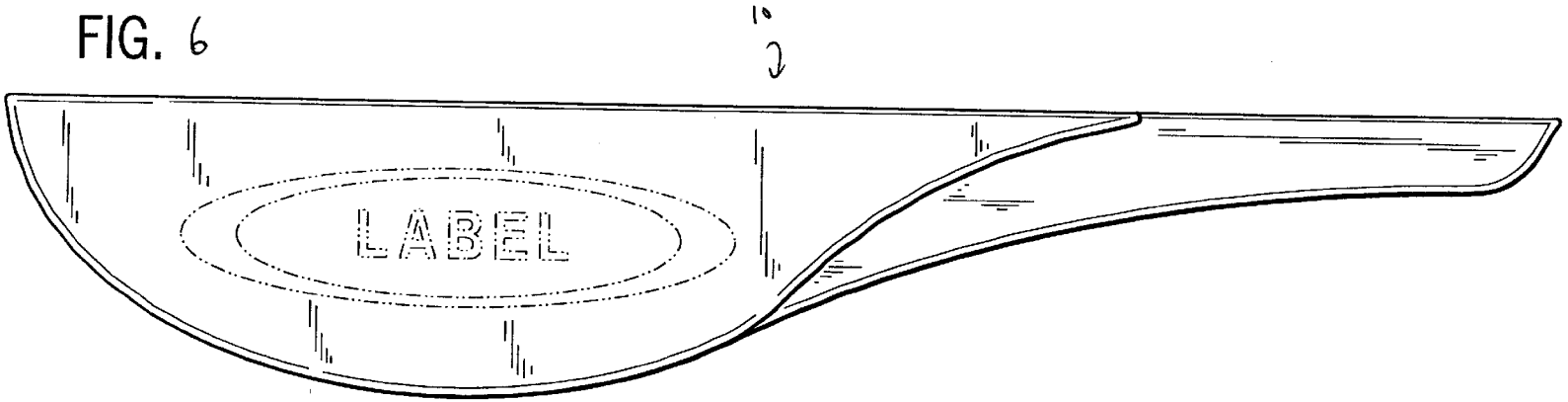
FIG. 6 is a front view of the soft label holder with the opening shown in phantom lines.
Figure 7:
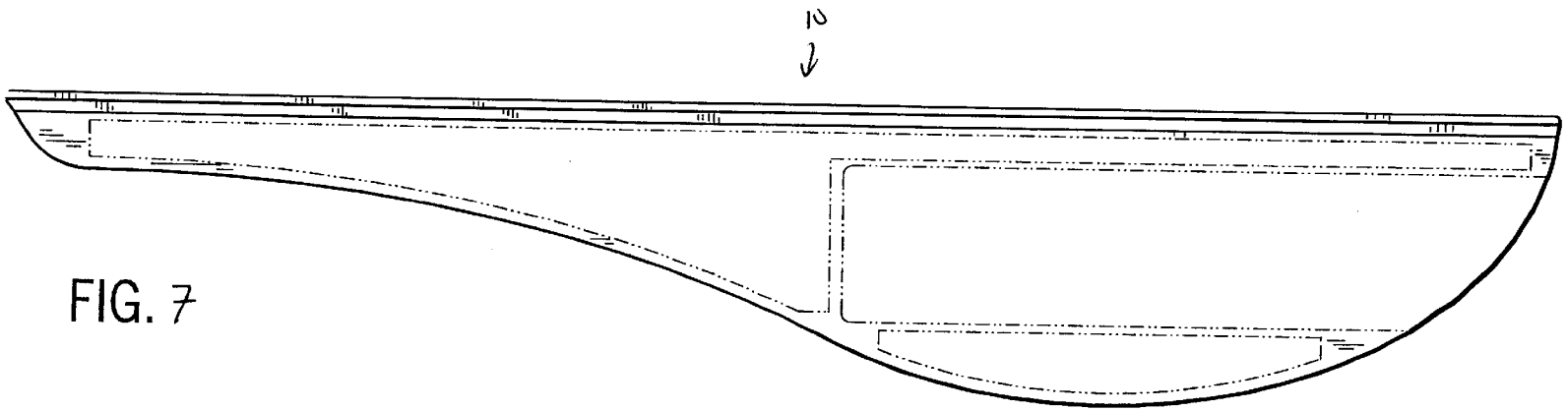
FIG. 7 is a rear view of the soft label holder of FIG. 6 illustrating the outline of the soft label holder.
Figure 8:
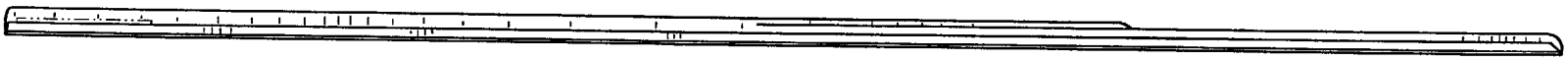
FIG. 8 is a bottom view of the soft label holder of FIG. 6.
Figure 9:
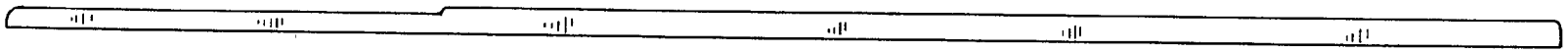
FIG. 9 is a top view of the soft label holder of FIG. 6.
Figure 10:
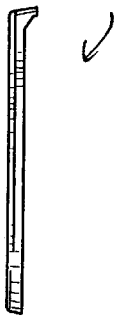
FIG. 10 is a left view of the soft label holder of FIG. 6.
Figure 11:
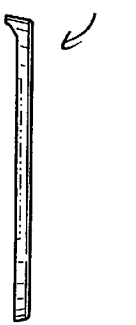
FIG. 11 is a right view of the soft label older of FIG. 6.

Referring to FIGS. 4 and 8, top region 18 includes a beveled area 26 that extends from first side 22 of body 16. Extending from beveled area 26 is a top edge region 28 that extends substantially perpendicular to the plane defined by the first side 22. A leading edge 30 extends substantially parallel to the first side 22 toward a top region 32. Beveled area 26 and top edge region 28 are configured to follow the contour of rigid edge 14 of file holder 12.

In the preferred embodiment, top region 18 interfaces with rigid edge 14 such that a portion of top region 18 extends above the rigid edge 14. Beveled area 26 of label holder body 12 is configured to match the contour of the beveled region 34 of the rigid edge 14 of file 12. In an alternative embodiment, the top region of the label holder may be configured to a file having a different contour. Referring to FIG. 1, the top region 18 of label holder 10 has a length dimensioned to cover a substantial length of rigid edge 14.

Referring to FIG. 2 two adhesive strips 36, 38 attach the first side 22 of body 12 to the front surface 40 of file 12. In the preferred embodiment, adhesive strips 36, 38 are double sided tape that can be applied to the label holder 10 and file 12 prior to being sold to a consumer. Alternatively, the label holder and double sided tape can be sold to a consumer as a kit for subsequent application to a rigid file 12.

Referring to FIG. 2, a depression 42 is formed on first side or backside 22 of body 12. The depression 42 extends from a first end 44 of label holder body 16. A label 46 is dimensioned to allow it to be slid into depression 42 from first end 44. An aperture 48 is formed through body 12, and provides a window through which label 46 can be viewed from front side 24 of label holder 10, once label 46 has been inserted into depression 42.

According to an alternative embodiment, aperture 48 and depression 42 may be omitted, and label 46 may be attached directly to second or front side 24, still providing identification of file 12.

In a second alternative embodiment, leading edge 14 is shaped to provide a slot (not shown) into body 16 into which rigid edge 14 could fit. In this embodiment, adhesive may be omitted. Of course, adhesive could also be used in this embodiment for a more secure connection between the label holder and file.

Referring to FIG. 2 a plastic insert 50 may be slid into the depression 44 between aperture 48 and label 46.

A soft member may also be attached to the edge of the file holder with an integrally formed clip. Further, the label holder may include a transparent covering. The transparent covering may be located over the aperture in the label holder and attached to the front face of the label holder. Additionally, a label may be removably received in a depression of a substantially flat body defining the label holder. The label may be removably received through an opening in the first end of the substantially flat body.

Although only a few exemplary embodiments of the present invention have been described in detail, those skilled in the art who review this disclosure will readily appreciate that many modifications are possible in the exemplary embodiments without materially departing from the novel teachings and advantages of this invention.

Accordingly, all such modifications are intended to be included within the scope of the invention as defined in the following claims. In the claims, any means-plus-function clause is intended to cover the structures described herein as performing the recited function, and not only structural equivalents but also equivalent structures. Other substitutions, modifications, changes, and omissions may be made in the designs, operating conditions, and arrangements of the preferred embodiments without departing from the spirit of the invention as expressed in the appended claims.

What is claimed is:

1. A rigid file and soft label holder, comprising:

a rigid file having a front surface and a top edge;

a soft member including a front surface, a rear surface, a top edge, a bottom edge, a first end, and a second end, the soft member including an aperture extending through the front and rear surfaces;

the soft member being secured to the front surface of the rigid file and the top edge of the soft member being located proximate to the top edge of the file to cover the top edge of the rigid file;

wherein the soft member has a durometer hardness less than a durometer hardness of the rigid file.

2. The rigid file and soft label holder of claim 1, wherein the soft member includes a depression region extending from the rear surface a predetermined distance toward the front surface, and extending from the first end a predetermined distance toward the second end.

3. The rigid file and soft label holder of claim 2, further including a label removably received in the depression and visible through the aperture.

4. The rigid file and soft label holder of claim 3, wherein the label is removably received in the depression region through the first end.

5. The rigid file and soft label holder of claim 1, wherein the soft member is constructed from SANTOPRENE.

6. The rigid file and soft label holder of claim 3, wherein the soft member is attached to the edge of the rigid file with an adhesive.

7. The rigid file and soft label holder of claim 4, wherein the soft member is attached to the top edge of the rigid file with an integrally formed clip.

8. The rigid file and soft label holder of claim 3, further comprising a transparent covering located over the aperture.

9. A file holder having a label holder comprising:

a file holder including an edge;

a substantially flat body having a front face and a rear face, the substantially flat body having at least one edge of predetermined length configured to substantially cover the edge of the file holder, the substantially flat body having an aperture extending therethrough;

the substantially flat body including a depression formed in the rear face of the substantially flat body and surrounding the aperture;

the substantially flat body having a durometer hardness less than a durometer hardness of the file holder;

the rear face of the substantially flat body being attached to the edge of the file holder; and a label removably inserted into the depression and visible through the aperture.

10. The file of claim 9, wherein the edge of the file holder includes a beveled region, the substantially flat body including a beveled area extending from the rear face and in contact with the beveled region of the file.

11. The file of claim 10, wherein the label is removably received in the depression through an opening in the first end of the substantially flat body.

12. The label holder of claim 11, wherein the substantially flat body is constructed from SANTOPRENE.

13. The label holder of claim 12, wherein the substantially flat body is attached to the edge of the file holder with an adhesive.

14. The label holder of claim 13, wherein the adhesive is two sided tape.

15. A file holder and soft label holder, for protecting a user's hand while near an edge of a file holder, comprising:

a soft member having a front face and a rear face, the soft member having at least one edge of predetermined length configured to substantially cover an edge of the file holder, the soft member having an aperture extending therethrough;

the soft member including a depression formed in the rear face of the soft member and surrounding the aperture;

the soft member being attached to the edge of thefiled holder along the edge of predetermined length on the rear face of the soft member;

the substantially soft member having a durometer hardness less than a durometer hardness of the file holder; and a label removably inserted into the depression and visible through the aperture.

16. The file hodler and soft label holder of claim 15, wherein the depression extends from the rear face a predetermined distance toward the front face, and extends from a first end of the soft member a predetermined distance toward a second end of the soft member.

17. The file holder and soft label holder of claim 16, wherein the aperture extends from the front face toward the rear face, the aperture extending into the depression; and a label being removably received in the depression and visible through the aperture.

18. The file holder and soft label holder of claim 17, wherein the label is removably received in the depression through the first end.

19. The file holder and soft label holder of claim 18, wherein the soft member is constructed from SANTOPRENE.

* * * * *